US005876566A

United States Patent [19]

Frawley, Jr.

[11] Patent Number: 5,876,566

[45] Date of Patent: Mar. 2, 1999

[54] SUCTION ROLL SEALING STRIP

[75] Inventor: Thomas Edward Frawley, Jr., Appleton, Wis.

[73] Assignee: Appleton Specialty Products, Inc., Kimberly, Wis.

[21] Appl. No.: 856,540

[22] Filed: May 15, 1997

[51] Int. Cl.[6] ..... D21F 3/10

[52] U.S. Cl. ..... 162/374; 162/371; 277/407; 277/944; 277/946

[58] Field of Search ..... 162/374, 369, 162/371, 363; 277/407, 938, 944, 946

[56] References Cited

U.S. PATENT DOCUMENTS 2,578,551 12/1951 Hornbostel .
4,714,523 12/1987 Sawyer, Jr. et al. ..... 162/371
4,915,787 4/1990 Branyon et al. ..... 162/199
5,515,619 5/1996 Kahl et al. ..... 34/114
5,580,424 12/1996 Snellman ..... 162/371

*Primary Examiner*—Peter Chin
*Assistant Examiner*—Steven B. Leavitt
*Attorney, Agent, or Firm*—Godfrey & Kahn, S.C.

[57] ABSTRACT

A composite is provided for forming a sealing strip for use in a suction roll of a papermaking machine that has extended usability and wear. The composite is a blend of a nitrile rubber, graphite, carbon black, and polytetrafluoroethylene, optionally with a phenolic resin. The sealing strip has polytetrafluoroethylene evenly distributed over the contact surface and when installed into a suction roll provides a reduced frictional surface.

16 Claims, 2 Drawing Sheets

SUCTION ROLL SEALING STRIP

FIELD OF THE INVENTION

The present invention relates to a composite for forming a sealing strip for use in a suction roll of a papermaking machine.

BACKGROUND OF THE INVENTION

In a continuous papermaking machine such as a Fourdrinier machine, paper sheets are formed by passing a fiber and water slurry from a headbox onto a mesh screen and draining off the water to form a sheet of paper fiber. The sheet is then moved through a press section with rollers that expresses the water, and a dryer section to reduce the moisture content from about 60% to about 5%. The dried sheet is then fed to a high-speed calendar for compaction and finishing.

The drying section is typically composed of a series of revolving suction rolls. A screen belt that supports the paper sheet passes over the suction rolls at high speed. A suction roll is generally composed of a stationary vacuum box that is centrally disposed inside a perforated cylinder or shell. The vacuum box has a slot opening and a sealing strip on either side of the opening. The sealing strips are pressed against the inner surface of the perforated shell to form a seal so that, as the perforated shell rotates about the vacuum box, water from the paper sheet is drawn through the holes of the shell and the slot opening into the vacuum box. Due to the continuous abrasive contact with the inside surface of the rotating shell, the sealing strips become worn out after a relatively short time and must be replaced, which requires a complete shutdown of the machinery.

Attempts have been made to develop sealing strips having increased durability and a longer life. U.S. Pat. No. 4,714,523 (Sawyer) discloses a sealing strip made of a wear-resistant material with a narrow inlay strip of polytetrafluoroethylene (PTFE; Teflon™) that is exposed along the surface of the edge of the sealing strip. The PTFE strip rubs against the inside surface of the shell to lubricate the interface of the two elements and reduce friction. Although useful, a drawback of this sealing strip is that the PTFE insert strip can wear down to below the contact surface such that the PTFE insert is no longer effective in contacting and lubricating the shell surface. Another drawback is that the sealing strip requires an initial time interim for the PTFE to become distributed over the surface to provide a level of lubrication that allows a smooth interaction between the rotating shell and the sealing strips.

Therefore, an object of the invention is to provide a composite for forming a sealing strip for mounting in a suction roll of a papermaking machine that is highly durable and has increased compatibility and reduced abrasion against the inside surface of the perforated cylinder of a suction roll. Another object is to provide a sealing strip that will provide a high level of lubrication substantially immediately upon use and throughout the life of the sealing strip.

SUMMARY OF THE INVENTION

These and other objects are achieved by the present invention which is directed to a composite for forming a sealing strip for use in a suction roll of a papermaking machine that has extended usability and wear, and a low coefficient of friction.

The composite is a blend of a nitrile rubber, graphite, and carbon black with polytetrafluoroethylene (PTFE, e.g., Teflon™) dispersed throughout, and optional additives and processing aids as desired. Optionally, but preferably, the composite can include a phenolic resin for increased hardness and flexural properties. The ingredients are compounded together and can be processed into a sealing strip, for example, by extrusion or compression molding. The composite includes an effective amount of polytetrafluoroethylene ranging from a trace amount to about 30 wt-% to provide a sealing strip that has the polytetrafluoroethylene distributed throughout the contact surface, and a low frictional coefficient of about 0.02–0.06.

Advantageously, a sealing strip formed from the composite has reduced coefficient of friction substantially immediately upon use which increases the life of both the sealing strip and the perforated shell as compared to conventional sealing strips. Use of the present sealing strips in a suction roll will also reduce the amount of heat that is generated from the contact of the sealing strip with the shell surface.

BRIEF DESCRIPTION OF THE DRAWINGS

Throughout the following views, reference numerals will be used in the drawings, and like reference numerals will be used throughout the several views and in the description to indicate corresponding parts of the invention.

DETAILED DESCRIPTION OF THE INVENTION

The present invention provides a composite for forming a sealing strip for use in a suction roll assembly of a papermaking machine. The amounts of ingredients are given in parts based on 100 parts of the nitrile rubber and in wt-% amounts based on the entire composition.

Figure 1:
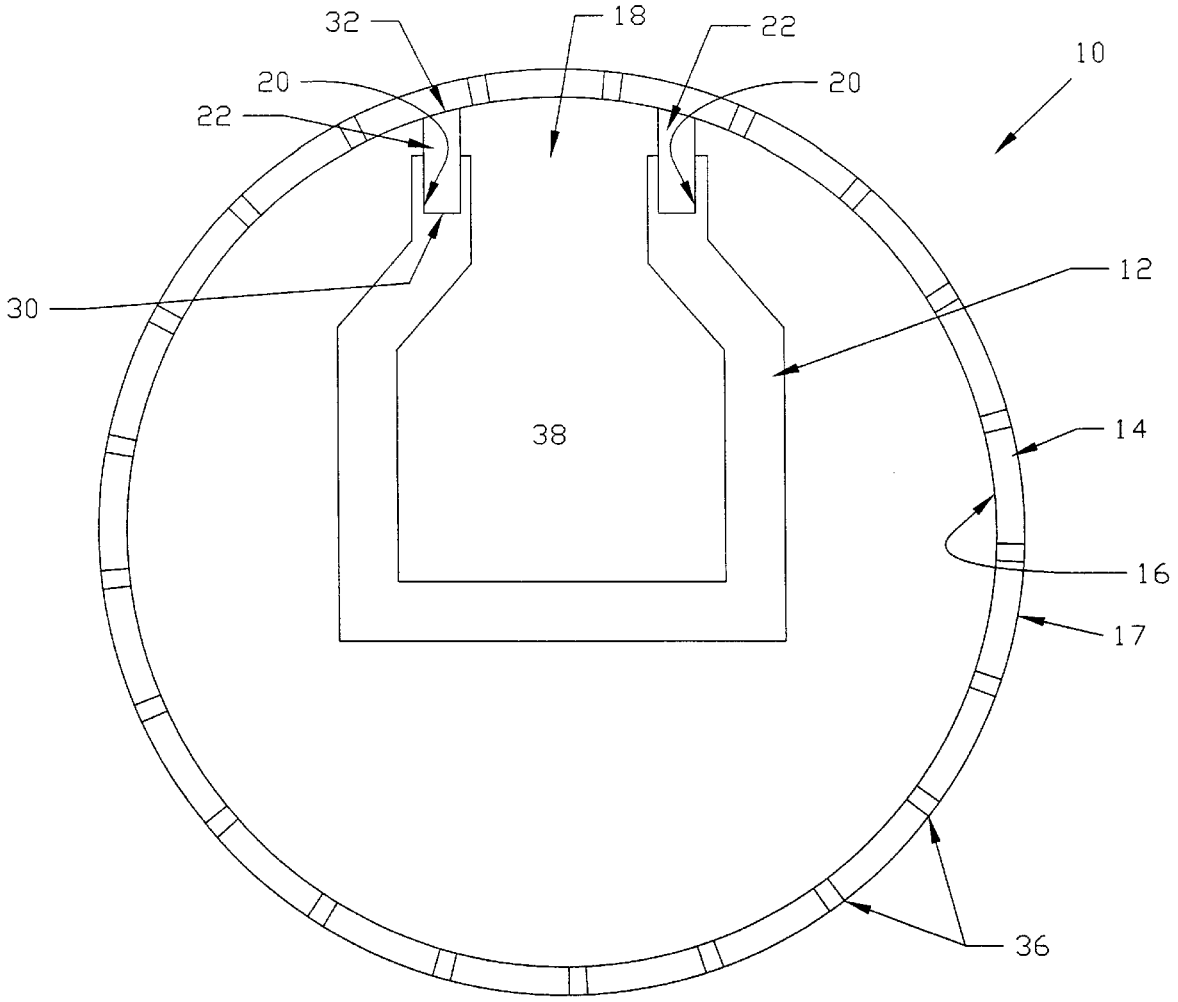
FIG. 1 is a sectional view of a sealing strip in association with a prior art suction roll assembly of a papermaking machine.

Referring now to the drawings, FIG. 1 depicts a prior art suction roll assembly, designated generally by reference numeral 10, of a papermaking machine such as a Fourdrinier machine for forming paper from a pulp slurry. The suction roll assembly 10 is composed of a stationary vacuum box 12 centrally disposed within a perforated cylindrical shell 14 that, in use, rotates about the vacuum box 12. The cylindrical shell 14 has an inside surface 16 and an outside surface 17, and is typically fabricated from bronze, stainless steel or other like material. The vacuum box 12 has a slot opening 18 and two U-shaped slots 20 that extend the width 21 of the vacuum box 12 along the opening 18 and are each sized to receive a sealing strip 22 therein.

Figure 2:
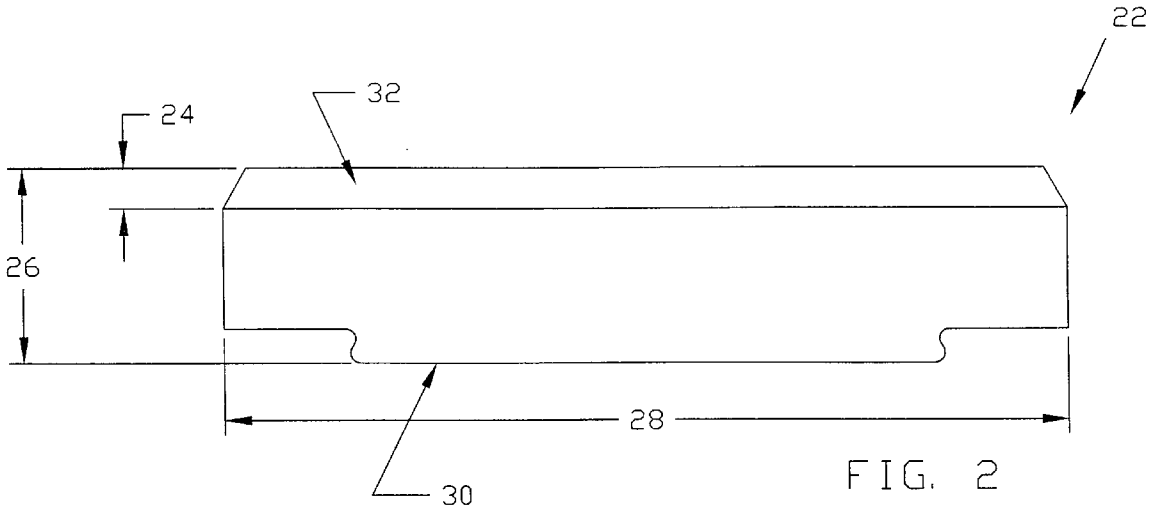
FIG. 2 is a front view of a sealing strip for use in the suction roll assembly of FIG. 1.

An example of a sealing strip 22 is shown in FIG. 2. The sealing strip 22 is generally an elongate rectangular block with a width 24, height 26 and length 28, and an opposing base edge 30 and contact edge 32. A typical sealing strip is about ¾" wide and about 2" high, with a length 28 that corresponds to the width of the U-shaped slot 20 of the vacuum box 12. The sealing strip 22 can be formed from a plurality of interfitting pieces (not shown). The sealing strip 22 is sized to fit into the U-shaped slot 20 with the contact edge 32 of the sealing strip 22 extending outward from the slot 20 so as to engage the inside surface 16 of the cylindrical shell 14 when the vacuum box 12 is disposed within the shell 14. The contact edge 32 of the sealing strip 22 will form and maintain a seal against the inside surface 16 of the cylindrical shell 14 to cause fluid from a paper slurry (not shown) passing along the outside surface 17 of the cylindrical shell 14 to be drawn through the perforations 36 and the slot opening 18 into the interior portion 38 of the vacuum box 12.

According to the present invention, the composite for forming a sealing strip 22 is composed of an acrylonitrile rubber, graphite, carbon black and polytetrafluoroethylene (PTFE) that are blended and compounded together. A sealing strip formed from the composite will have PTFE dispersed throughout the contact edge 32 and the body of the strip. The sealing strip 22 is highly durable and, when installed into a suction roll assembly, will maintain an effective seal with the shell 14 and provide a low abrasion resistance and frictional contact with the inside surface 16 of the shell 14.

The base material of the composite is an acrylonitrile rubber (nitrile-butadiene rubber, NBR). A preferred nitrile rubber for the composite is Hycar® 1052, and the like, available commercially from Goodyear. The composition includes about 10–25 wt-% nitrile rubber, preferably about 15–20 wt-%.

Carbon black is included as a reinforcing agent to provide abrasion resistance, tear resistance and tensile strength. Based on about 100 parts of the nitrile rubber base material, the composition includes about 50–100 parts carbon black, preferably about 55–65 parts, or about 5–15 wt-%.

The composite includes graphite for structure and as a lubricating agent. The composite is composed of about 25–45 wt-% graphite, preferably about 30–40 wt-%, or about 150–200 parts graphite, preferably about 175–185 parts, based on 100 parts nitrile rubber.

The composite further includes an effective amount of polytetrafluoroethylene (PTFE) as a lubricating agent to provide a low coefficient of friction between the contact edge 32 of the sealing strip 22 and the inside surface 16 of the cylindrical shell 14. Polytetrafluorethylene is available commercially under the tradenames Teflon™ (DuPont) and Halon™ (Allied-Signal), and preferably is used in powder form. The amount of PTFE included in the composite is about 0.1–30 wt-%, preferably about 5–25 wt-%, preferably about 10–20 wt-%, or based on 100 parts of the nitrile rubber base material, about 50–70 parts, preferably about 55–65 parts.

The composite further includes about 1–10 wt-% of a vulcanizing agent (e.g., sulfur), or about 20–30 parts based on 100 parts of the nitrile rubber component. The composition can also include an accelerating agent, as for example, N-cyclohexylbenzothiazyl sulphenamide (e.g., Santocure MOR™, Monsanto) or other thiazole accelerator, preferably at about 0.05–0.15 wt-%, or about 0.8–1.2 parts/100 parts nitrile rubber.

It is preferred that the composition is formulated with an effective amount of a phenolic resin to enhance surface hardness and increase flexural properties. An example of a useful phenolic resin is Akrochem® P86 (Akrochem Company, Akron, Ohio), and the like. The composition can include about 10–20 wt-% phenolic resin, or about 25–100 parts, preferably about 70–80 parts, based on about 100 parts of the nitrile rubber base material. About 1–2 wt-% of a crosslinking/curing agent is preferably included with the phenolic resin, as for example, hexamethylenetetramine (HEXA).

The composite can further include minor but effective amounts of optional additives and processing aids as desired. Such optional ingredients include, for example, a stabilizing agent such as stearic acid or other organic acid at about 0.2–1 wt-% (about 1–4 parts per 100 parts nitrile rubber); a dehydrating agent such as calcium oxide (e.g., Desical™) at about 1–5 wt-% (about 5–10 parts); and processing aids to decrease the viscosity and improve workability, flow and adherence. Useful processing aids include, for example, a metallic oxide (e.g., zinc oxide) at about 0.5–1.5 wt-% (about 3–8 parts/100 parts nitrile rubber); a softener/tackifier, as for example,. a coumarine-indene resin (e.g., Cumar™ from Neville) at about 1–2 wt-% (about 5–10 parts/100 parts nitrile rubber); and a plasticizer/dispersing agent (e.g., Struktol®WB 222, Struktol Company of America, Stow, Ohio) at about 0.2–1 wt-% (about 1–4 parts per 100 parts nitrile rubber). The composite can also include an effective amount of an antioxidant to improve resistance to deterioration.

The composite ingredients are blended together by common rubber compounding methods using a roll mill and/or internal mixer (e.g., Banbury mixer) to achieve a substantially uniform blend of the constituents. The composite can be extruded into a bar form for finish machining or compression molded into a rectangular block, and processed by vulcanization, all according to standard techniques known and used in the art. The dimensions of a typical sealing strip are about ¾" in width (w) by about 2" in height (h) with a length (1) 28 that will vary according to the width of the vacuum box 12.

As the cylindrical shell 14 rotates against the sealing strip 22, the contact surface 32 of the sealing strip 22 wears down gradually due to the continuous contact with the inside surface 16 of the shell 14, and the polytetrafluoroethylene (PTFE) is substantially evenly coated over the surface of the contact edge 32. The contact edge 32 of the sealing strip 22 rubs against the inside surface 16 of the shell 14 which causes the PTFE to become smeared onto the inside surface 16, thus lubricating and reducing the friction between the two members.

Figure 3:
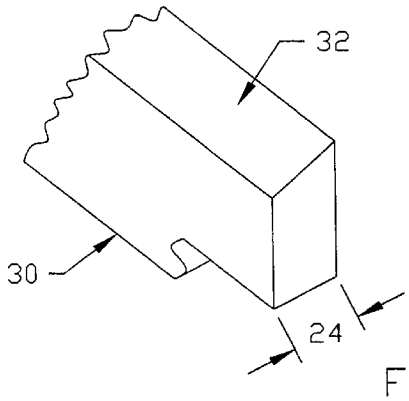
FIG. 3 is a partial perspective view of the sealing strip of FIG. 2.
Figure 4:
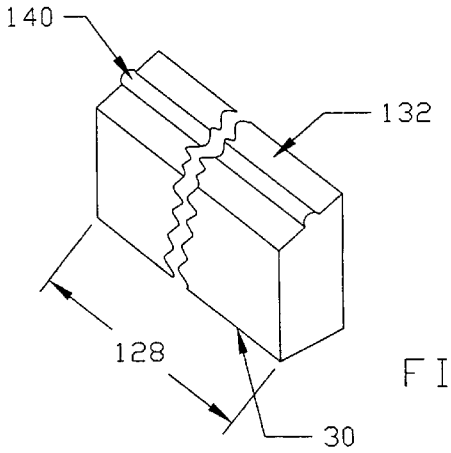
FIG. 4 is a partial perspective view of a second embodiment of a sealing strip.

The contact edge 32 of the sealing strip 22 can be substantially linear and smooth as shown in FIG. 2, or can include a protrusion 140 extending the length 128 of the sealing strip 122 as shown in FIG. 3. The protrusion 140 advantageously provides a smaller surface area to quickly conform to irregularities that may be present in the inside surface 16 of the shell 14.

The advantage of a sealing strip formulated from the present composite with PTFE distributed throughout the contact edge 32 as compared to a sealing strip having a strip inlay of PTFE such as provided by Sawyer (U.S. Pat. No. 4,714,523) is that the present sealing strip is less abrasive and more compatible with the shell of the suction roll, and provides a suitable level of lubrication substantially immediately upon use. Sealing strips made from the present composite advantageously are longer lasting and provide a lower coefficient of friction against the inside surface 16 of the cylindrical shell 14 compared to other conventional composite sealing strips that do not have the PTFE distributed throughout. In addition, the PTFE remains evenly distributed and available for lubricating the surface 16 of the shell 14 for the life of the sealing strip, whereas an inlay strip of PTFE is only effective for lubrication while the PTFE strip itself is in contact with the shell surface.

The invention will be further described by reference to the following detailed example. This example is not meant to limit the scope of the invention that has been set forth in the foregoing description. It should be understood that many variations and modifications may be made while remaining within the spirit and scope of the invention. The invention is not to be construed as limited to the specific embodiments shown in the drawings. The disclosures of the cited references are incorporated by reference herein.

EXAMPLE

Sealing Strip Composite

Nitrile Rubber, graphite and carbon black were blended together with processing aids according to the below-listed formulation. A phenolic resin (e.g., Akrochem® P86; Akrochem Company, Akron, Ohio) was added to enhance the flexural properties and surface hardness of the formed sealing strip. The Teflon™ PTFE component was added to the mixture in fine powder form for even dispersion.

| Ingredient | Parts |
|---|---|
| Hycar ™ nitrile rubber | 100.00 |
| Teflon ™ PTFE | 60.00 |
| Graphite | 180.00 |
| Carbon black | 60.00 |
| Zinc oxide | 5.00 |
| Stearic acid | 2.00 |
| Age Rite ™ resin | 2.00 |
| Struktol ® WB 222 plasticizer/dispersant | 2.00 |
| HEXA (curing agent) | 9.00 |
| Sulfur | 25.00 |
| Santocure MOR ™ accelerator | 1.00 |
| Akrochem ® P86 phenolic resin | 75.00 |
| Cumar ™ resin | 8.00 |
| Desical ™ desiccant | 7.00 |

The components were blended together using a Banbury mixer, and then extruded into a bar form and machine finished. The finished sealing strip had the PTFE component evenly dispersed throughout. Because of the nature of PTFE, as the material wears, the PTFE levels out on the contact surface of the sealing strip and provides a reduced friction surface against the inside of the perforated cylindrical shell of the suction roll. This reduces shell wear and heat while improving the abrasion resistance of the seals.

What is claimed:

1. A sealing strip for use in a vacuum box of a suction roll of a papermaking machine, the vacuum box being centrally disposed inside a rotatable perforated cylindrical shell of the suction roll; the sealing strip comprising:

a composite blend of about 10–25 wt-% nitrile rubber, about 25–45 wt% graphite, about 5 . 15 wt-% carbon black, and 0.1–30 wt-% polytetrafluoroethylene; the sealing strip having a length, height, width, base edge and contact edge;

wherein when the sealing strip is disposed in the vacuum box and the contact edge engages the cylindrical shell, the contact edge maintains a seal effective to cause suction of a fluid through the perforations of the cylindrical shell into the vacuum box, and provides a low coefficient of friction of about 0.02–0.06 as the contact edge moves along the inside surface of the rotating cylindrical shell.

2. The sealing strip according to claim 1, comprising about 5–25 wt-% polytetrafluoroethylene.

3. The sealing strip according to claim 1, comprising about 10–20 wt-% polytetrafluoroethylene.

4. The sealing strip according to claim 1, comprising:

(a) about 100 parts nitrile rubber;

(b) about 50–100 parts carbon black;

(c) about 150–200 parts graphite; and (d) about 50–70 parts polytetrafluoroethylene.

5. The sealing strip according to claim 4, wherein the composite further comprises about 25–100 parts of a phenolic resin.

6. The sealing strip according to claim 1, wherein the composite further comprises: an additive selected from the group consisting of a vulcanizing agent, accelerator, stabilizing agent, dehydrating agent, curing agent, softener, antioxidant, plasticizer, and any combination thereof.

7. The sealing strip according to claim 1, wherein the contact edge comprises a protrusion along the length of the sealing strip.

8. A sealing strip for use in a vacuum box of a suction roll of a papermaking machine, the vacuum box being centrally disposed inside a rotatable perforated cylindrical shell of the suction roll, the sealing strip having an opposing base edge and a contact edge, and the shell having an inside surface; the sealing strip comprising a composite blend of:

(a) about 100 parts nitrile rubber;

(b) about 50–100 parts carbon black;

(c) about 150–200 parts graphite; and (d) about 50–70 parts polytetrafluoroethylene;

wherein when the sealing strip is disposed in the vacuum box and placed in contact with the inside surface of the cylindrical shell, the sealing strip forms a seal effective to cause suction of a fluid through the perforations of the cylindrical shell into the vacuum box, and the contact edge of the sealing strip provides a low coefficient of friction against the inside surface of the cylindrical shell as the shell rotates around the vacuum box.

9. The sealing strip according to claim 8, wherein the composite further about 25–100 parts phenolic resin.

10. A suction roll of a papermaking machine, comprising:

a stationary vacuum box centrally disposed within a perforated cylindrical shell rotatable around the vacuum box; the vacuum box having a width and a U-shaped slot extending the width, and the cylindrical shell having an inside surface;

a composite sealing strip having a length, width and height, and opposing base and contact edges; the sealing strip disposed within the U-shaped slot and extending the width of the slot with the contact edge extending out of the slot; the contact edge having a surface adapted to engage the inside surface of the cylindrical shell to form a seal;

the sealing strip comprising a composite blend of about 10–25 wt-% nitrile rubber, about 25–45 wt% graphite, about 5–15 wt-% carbon black, and 0.1–30 wt-% polytetrafluoroethylene, which provides the contact edge of the sealing strip with a surface having a low coefficient of friction of about 0.02–0.06 as the contact edge moves along the inside surface of the rotating cylindrical shell.

11. The suction roll according to claim 10, wherein the composite comprises:

(a) about 100 parts nitrile rubber;

(b) about 50–100 parts carbon black;

(c) about 150–200 parts graphite; and (d) about 50–70 parts polytetrafluoroethylene.

12. The suction roll according to claim 11, wherein the composite further comprises about 25–100 parts of a phenolic resin.

13. In a papermaking machine, a method of sealing a juncture between a vacuum box and a perforated cylindrical shell of a suction roll, the vacuum box being disposed within the perforated cylindrical shell that is rotatable around the vacuum box, the vacuum box having a width and a U-shaped slot extending the width, and the cylindrical shell having an inside surface, the method comprising:

(a) providing a composite sealing strip having a length, width and height, and opposing base and contact edges; the strip being sized to be disposed within the U-shaped slot with the length of the strip extending the width of the vacuum box; the contact edge having a surface adapted to engage the inside surface of the cylindrical shell to form a seal;

the sealing strip composed of a composite blend of about 10–25 wt-% nitrile rubber, about 25–45 wt% graphite, about 5–15 wt-% carbon black, and 0.1–30 wt-% polytetrafluoroethylene, which provides the contact edge of the sealing strip with a low coefficient of friction when placed into contact with the inside surface of the cylindrical shell and as the shell rotates against the contact edge of the sealing strip;

(b) inserting the sealing strip into the U-shaped slot of the vacuum box with the contact edge extending out of the slot; and (c) engaging the contact edge of the sealing strip against the inside surface of the cylindrical shell to form a seal effective to provide suction of a fluid through the perforations of the cylindrical shell into the vacuum box as the cylindrical shell rotates about the vacuum box;

wherein the contact edge of the sealing strip provides a low coefficient of friction of about 0.02–0.06 against the inside surface of the rotating cylindrical shell.

14. The method according to claim 13, further comprising prior to step (a), forming the sealing strip by;

(i) compounding together to form a composite blend of:
(a) about 100 parts nitrile rubber;
(b) about 50–100 parts carbon black;
(c) about 150–200 parts graphite; and
(d) about 50–70 parts polytetrafluoroethylene; and (ii) processing the composite into the sealing strip.

15. The method according to claim 14, wherein the composite further comprises about 25–100 parts phenolic resin.

16. The method according to claim 14, wherein the processing step (ii) comprises extruding or compression molding the composite.

* * * * *